US009295596B2

(12) United States Patent
He

(10) Patent No.: US 9,295,596 B2
(45) Date of Patent: Mar. 29, 2016

(54) COMBINED NURSING BED

(71) Applicant: Yancheng Lucky Stationery Co., Ltd., Sheyang (CN)

(72) Inventor: Hanzhong He, Sheyang (CN)

(73) Assignee: Jiangsu Hengai Medical Equipment Co., Ltd., Sheyang (CN)

( * ) Notice: Subject to any disclaimer, the term of this patent is extended or adjusted under 35 U.S.C. 154(b) by 0 days.

(21) Appl. No.: 14/333,492

(22) Filed: Jul. 16, 2014

(65) Prior Publication Data

US 2014/0327232 A1 Nov. 6, 2014

Related U.S. Application Data

(63) Continuation-in-part of application No. PCT/CN2013/000229, filed on Mar. 5, 2013.

(30) Foreign Application Priority Data

| | | |
|---|---|---|
| Mar. 1, 2012 | (CN) | 2012 2 0101947 U |
| Jul. 19, 2012 | (CN) | 2012 1 0272777 |
| Feb. 27, 2013 | (CN) | 2013 1 0080242 |

(51) Int. Cl.

| | |
|---|---|
| ***A61G 7/00*** | (2006.01) |
| ***A61G 5/00*** | (2006.01) |
| ***A61G 7/053*** | (2006.01) |
| *A61G 7/16* | (2006.01) |

(52) U.S. Cl.

CPC *A61G 5/006* (2013.01); *A61G 7/00* (2013.01); *A61G 7/053* (2013.01); *A61G 2007/165* (2013.01)

(58) Field of Classification Search

CPC ..... A61G 5/006; A61G 5/1002; A61G 7/00; A61G 7/002; A61G 7/16; A61G 7/053; A61G 2007/165; A47K 11/04

See application file for complete search history.

(56) References Cited

U.S. PATENT DOCUMENTS

| | | | | | |
|---|---|---|---|---|---|
| 2,607,929 | A * | 8/1952 | Balluff | A61G 5/006 | 296/20 |
| 2,678,087 | A * | 5/1954 | McKinley | A61G 5/006 | 248/421 |
| 3,215,469 | A * | 11/1965 | Wamsley | A47C 1/035 | 108/135 |
| 3,936,893 | A * | 2/1976 | Anderson | A61G 5/006 | 297/19 |

(Continued)

FOREIGN PATENT DOCUMENTS

| | | | | |
|---|---|---|---|---|
| CN | 101342108 | A * | 6/2008 | A61G 7/005 |
| CN | 101926715 | A * | 12/2010 | A61G 7/00 |

(Continued)

*Primary Examiner* — Paul N Dickson
*Assistant Examiner* — Steve Clemmons
(74) *Attorney, Agent, or Firm* — Matthias Scholl, PC; Matthias Scholl

(57) ABSTRACT

A combined type nursing bed. A moveable backrest is provided on a fixed bed body, and a wheelchair is disposed at an end of the moveable backrest. The wheelchair includes three rectangular plates, a wheelchair support, and a second driving mechanism. When in use, the three rectangular plates are driven by the second driving mechanism and pivots around rotating shafts to form the wheelchair. The wheelchair can be separated from the bed body. Through separation and combination of the wheelchair and the bed body, a patient can be easily transferred. The transferring process does not require hard labor of the nursing personnel, and the patients do not suffer addition discomfort due to use of the nursing bed.

8 Claims, 13 Drawing Sheets

(56) References Cited

U.S. PATENT DOCUMENTS

| | | | | |
|---|---|---|---|---|
| 4,987,620 | A * | 1/1991 | Sharon | A61G 5/006 5/600 |
| 5,555,582 | A * | 9/1996 | Jerideau | A61G 5/006 5/600 |
| 6,272,702 | B1 * | 8/2001 | Uchida | A61G 5/006 5/600 |
| 6,584,629 | B2 * | 7/2003 | Tsuji | A61G 5/006 5/600 |
| 6,726,279 | B1 * | 4/2004 | Figel | A61G 5/006 297/340 |
| 6,742,206 | B1 * | 6/2004 | Han | A61G 5/006 280/250.1 |
| 2004/0227331 | A1 * | 11/2004 | Chen | A61G 5/006 280/650 |

FOREIGN PATENT DOCUMENTS

| | | | | |
|---|---|---|---|---|
| DE | 4130610 | A1 * | 3/1993 | A61G 5/006 |
| KR | WO 2011136439 | A1 * | 11/2011 | A47K 11/04 |

* cited by examiner

COMBINED NURSING BED

CROSS-REFERENCE TO RELATED APPLICATIONS

This application is a continuation-in-part of International Patent Application No. PCT/CN2013/000229 with an international filing date of Mar. 5, 2013, designating the United States, now pending, and further claims priority benefits to Chinese Patent Application No. 201220101947.8 filed Mar. 1, 2012, Chinese Patent Application No. 201210272777.4 filed Jul. 19, 2012, and Chinese Patent Application No. 201310080242.1 filed Feb. 27, 2013. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18$^{th}$ Floor, Cambridge, Mass. 02142.

BACKGROUND OF THE INVENTION

1. Field of the Invention

This invention relates to a nursing equipment, which is a combined type nursing bed.

2. Description of the Related Art

At present, nursing beds and wheelchairs are separated from each other. It is difficult to transfer patients or the elderly that cannot move freely. Not only the nursing personnel has to pay hard work, but also the patients and the elderly suffer.

SUMMARY OF THE INVENTION

In view of the above-described problems, it is one objective of the invention to provide a combined type nursing bed, wherein a part of the bed can be separated and form into a wheelchair.

In accordance with one embodiment of the invention, there is provided a combined type nursing bed, which comprises a bed body, a moveable backrest, and a wheelchair. The moveable backrest is disposed on the bed body and is hinged with the bed body through a first rotating shaft, and is driven by a first driving mechanism supported by the bed body. The wheelchair is disposed at an end of the moveable backrest. The wheelchair comprises three rectangular plates which are separated from the bed body, a wheelchair support, and a second driving mechanism. The width of the three rectangular plates is longer than that of a human body. The three rectangular plates are a first plate, a second plate, and a third plate. When a user is lying on the combined type nursing bed, a plate located below the hip of the user is the first plate. The first plate is supported by the wheelchair support and is fixed to the upper end of the wheelchair support. The first plate and the second plate are hinged through a second rotating shaft, the second plate and the third plate are hinged through a third rotating shaft. Wheels are disposed under the front and the rear of the wheelchair support. A telescopic component inside the second driving mechanism and a first tumbler fixed on the driving rotating shaft are moveably connected. A fixing component connected to the telescopic component is moveably connected to the bed body. A driving component is disposed on the fixing component. The driving rotating shaft and a driven rotating shaft supported by the wheelchair support are moveably connected, wherein the driving rotating shaft and the driven rotating shaft are able to rotate synchronously and able to be separated from each other. A second tumbler is fixed on the driven rotating shaft, and is moveably connected to a lower surface of the third plate. A moveable wheelchair backrest is disposed at the rear of the wheelchair support. Two moveable handles are disposed each at one of the two opposite ends of the first plate.

The driving rotating shaft is supported by the bed body. Two driving rotating shaft supports are disposed on and supported by the bed body. Axle holes are disposed each on one of the driving rotating shaft supports. The axle holes are circular or racetrack-shaped, wherein the straight sides of the racetrack-shaped axle holes are in the perpendicular direction. Two ends of a driving rotating shaft are disposed each in one of the driving rotating shaft supports. The driving rotating shaft is rotatable inside the axle holes and is slidable in the racetrack-shaped axle holes in the perpendicular direction.

The driving rotating shaft and the driven rotating shaft are moveably connected. A bolt is disposed in the driving rotating shaft. The bolt is fitted with an inner hole of the driven rotating shaft. The cross section of the bolt is non-circular. A bolt handle protrudes from an opening of the driving rotating shaft.

A moveable wheelchair backrest is disposed at the rear of the wheelchair support. The wheelchair backrest is pluggable and is able to move up and down. A pull rod of the wheelchair backrest is inserted into a tube; a slippage preventing step is disposed at the end of the pull rod, a rectangular groove and a inclined surface opposite to the rectangular groove 39 are disposed on the upper end of the slippage preventing step. A compressible bolt is disposed on the tube. When a backrest handle is turned into a working position, the compressible bolt is located in the rectangular groove; when the backrest handle is turned into a suppressible position, the compressible bolt is abutted against the declined surface.

Two moveable handles are disposed each at one of the two opposite ends of the fixed plate.

A compass tube is disposed at the rear of the wheelchair support. A fourth rotating shaft and a compass component are disposed between the wheelchair and the compass tube. A movable rod is disposed between the compass tube and a third tumbler of the driven rotating shaft. The pull rod of the wheelchair backrest is inserted into the compass tube.

A pivotable plate is disposed on the third plate of the wheelchair.

The second driving mechanism comprising the telescopic component and the fixing component is a mechanism able to perform a straight reciprocating motion, such as an electromotion rod, a manual push rod, a fluid cylinder, a gas cylinder, and a gas spring.

The manual push rod comprises a screw bolt and an inner screw thread. The front part of the manual push rod is the telescopic component, the rear part of the manual push rod is the fixing component which is moveably connected to the bed body, and a driving component disposed at the end of the fixing component is a crank. The electric push rod comprises a screw bolt and an inner screw thread. The front part of the electric push rod is the telescopic component, the rear part of the electric push rod is the fixing component which is moveably connected to the bed body, and a driving component disposed at the end of the fixing component is a motor.

A urinal and a holding plate used to hold the urinal are disposed under the first plate of the wheelchair. A covering plate is disposed on the first plate and a door plate is disposed on the second plate. Openings are disposed on the first plate and the second plate and are close to the covering plate and the door plate.

The combined type nursing bed comprises a bed body, a moveable backrest, and a wheelchair.

The moveable backrest is disposed on the bed body and is hinged with the bed body through a first rotating shaft. The moveable backrest is driven by a first driving mechanism supported by the bed body. The wheelchair is connected to an end of the moveable backrest. The wheelchair comprises three rectangular plates which are separated from the bed body, a wheelchair support, and a second driving mechanism. The width of the three rectangular plates is longer than that of a human body (about 500-600 mm) The three rectangular plates are a first plate, a second plate, and a third plate. When a user is lying on the combined type nursing bed, a plate located below the hip of the user is the first plate. The first plate is supported by the wheelchair support and is fixed to the upper end of the wheelchair support. The first plate and the second plate are hinged through a second rotating shaft, the second plate and the third plate are hinged through a third rotating shaft. Wheels are disposed under the front and the rear of the wheelchair support. A telescopic component inside the second driving mechanism and a first tumbler fixed on the driving rotating shaft are moveably connected. A fixing component connected to the telescopic component is moveably connected to the bed body. A driving component is disposed on the fixing component. The driving rotating shaft and a driven rotating shaft supported by the wheelchair support are moveably connected, wherein the driving rotating shaft and the driven rotating shaft are able to rotate synchronously and able to be separated from each other. A second tumbler is fixed on the driven rotating shaft, and is moveably connected to a lower surface of the third plate. Working step 1: the telescopic component is extended from the second driving mechanism to force the first tumbler of the driving rotating shaft rotates clockwise so that the driving rotating shaft rotates; the driven rotating shaft and the second tumbler are driven to rotate and the third plate is pulled down by the second tumbler; the second plate is driven by the third rotating shaft to pivot down from horizontal to vertical around the second rotating shaft; the third plate pivots up relative to the second plate around the third rotating shaft and is finally placed on the wheelchair support; therefore, the driving rotating shaft and the driven rotating shaft are separated, and the wheelchair and the bed body are separated and can be used independently. Working step 2: the driving rotating shaft is connected to the driven rotating shaft, the second driving mechanism works, the telescopic component is drawn back and pulls the first tumbler of the driving rotating shaft, the driving rotating shaft drives the driven rotating shaft and the second tumbler to rotate, the second tumbler pushes up the third plate, the wheelchair changes into a bed surface. The working steps are adapted when the driving rotating shaft and the driven rotating shaft are arranged in different height.

The driving rotating shaft is supported by the bed body, and two driving rotating shaft supports are disposed on and supported by the bed body. Axle holes are disposed each on one of the driving rotating shaft supports. The axle holes are circular or racetrack-shaped, wherein the straight sides of the racetrack-shaped axle holes are in the perpendicular direction. Two ends of a driving rotating shaft are disposed each in one of the driving rotating shaft supports. The driving rotating shaft is rotatable inside the axle holes and is slidable in the racetrack-shaped axle holes in the perpendicular direction. The driven rotating shaft is supported by the wheelchair support and is slidable in the horizontal direction. The driving rotating shaft and the driven rotating shaft are moveably connected and are able to be separated. The driving rotating shaft and the driven rotating shaft are moveably connected. A bolt which is fitted with an inner hole of the driven rotating shaft is disposed in the driving rotating shaft. The cross section of the bolt is rectangular. A bolt handle protrudes from an opening of the driving rotating shaft. Aligning the driving rotating shaft with the driven rotating shaft, pushing the bolt handle so that the driving rotating shaft and the driven rotating shaft are connected and pulling the bolt handle so that the driving rotating shaft and the driven rotating shaft are separated. The bolt can be also disposed on the driven rotating shaft to fit with the driving rotating shaft.

A wheelchair backrest is disposed at the rear of the wheelchair support. The wheelchair backrest is pluggable and is able to move up and down. A pull rod of the wheelchair backrest is inserted into a tube; a pluggable slippage preventing mechanism is disposed at the end of the pull rod: a slippage preventing step is disposed at the end of the pull rod, a rectangular groove and a inclined surface opposite to the rectangular groove are disposed on the upper end of the slippage preventing step. When the pull rod is being pulled up, the slippage preventing step is stuck by a compressible bolt so that the pull rod is not drawn out. When a backrest handle is turned into a working position, the compressible bolt is located in the rectangular groove, the pull rod is stuck by the compressible bolt and is not able to move up and down; when the backrest handle is turned into a suppressible position, the compressible bolt is abutted against the declined surface, the pull rod is able to be inserted into the tube and to be hidden below the bed surface. Many structures can be used as the pull rod, such as the draw bar of a draw bar of a suitcase.

Two moveable handles are disposed each at one of the two opposite ends of the fixed plate.

A urinal and a holding plate used to hold the urinal is disposed under the fixed plate of the wheelchair. A covering plate is disposed on the fixed plate and a door plate is disposed on the second plate. Openings are disposed on the frame close to the covering plate.

The telescopic component and the fixing component of the second driving mechanism are connected to form a mechanism which is able to perform a straight reciprocating motion, such as an electromotion rod, a manual push rod, a gas cylinder, a fluid cylinder, and a gas spring.

The manual push rod comprises a screw bolt and an inner screw thread. The front part of the manual push rod is the telescopic component, the rear part of the manual push rod is the fixing component which is moveably connected to the bed body, and a driving component at the end of the fixing component is a crank. The electric push rod comprises a screw bolt and an inner screw thread. The front part of the electric push rod is the telescopic component, the rear part of the electric push rod is the fixing component which is moveably connected to the bed body, and a driving component at the end of the fixing component is a motor.

When the mechanism which is able to perform a straight reciprocating motion is a gas cylinder, a fluid cylinder, or a gas spring, there is no driving component disposed at the end of the fixing component.

A compass tube is disposed at the rear of the wheelchair support. A fourth rotating shaft and a compass component are disposed between the wheelchair and the compass tube. A movable rod is disposed between the compass tube and a third tumbler of the driven rotating shaft. The moveable rod is able to be separated from the compass tube and the third tumbler of the driven rotating shaft. The pull rod of the wheelchair backrest is inserted into the compass tube. Turn the wheelchair backrest, the driven rotating shaft is driven by the moveable rod, and the third plate 6 is lifted by the tumble. As a result, the wheelchair changes into a moveable bed.

A pivotable plate is disposed on the third plate of the wheelchair.

The wheelchair can be separated from the combined type nursing bed. Through separation and combination of the wheelchair and the bed body, the nursed can be transferred. The transfer process does not require hard labor of the nursing personnel, and the nursed does not suffer from pain because of being pulled.

DETAILED DESCRIPTION OF THE EMBODIMENTS

Figure 1:
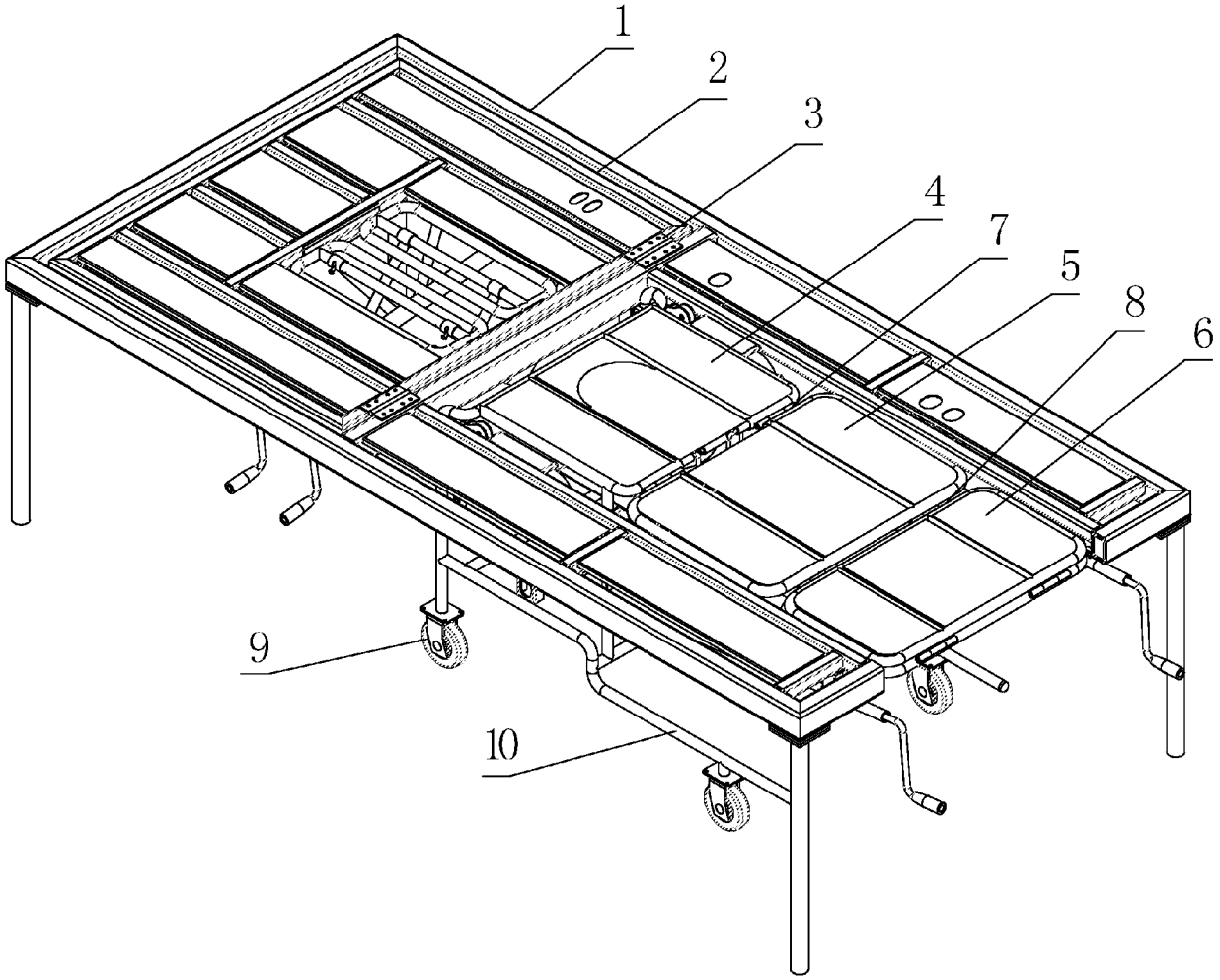
FIG. 1 is a space diagram of a combined type nursing bed which has a manual push rod and is in a combined status.
Figure 2:
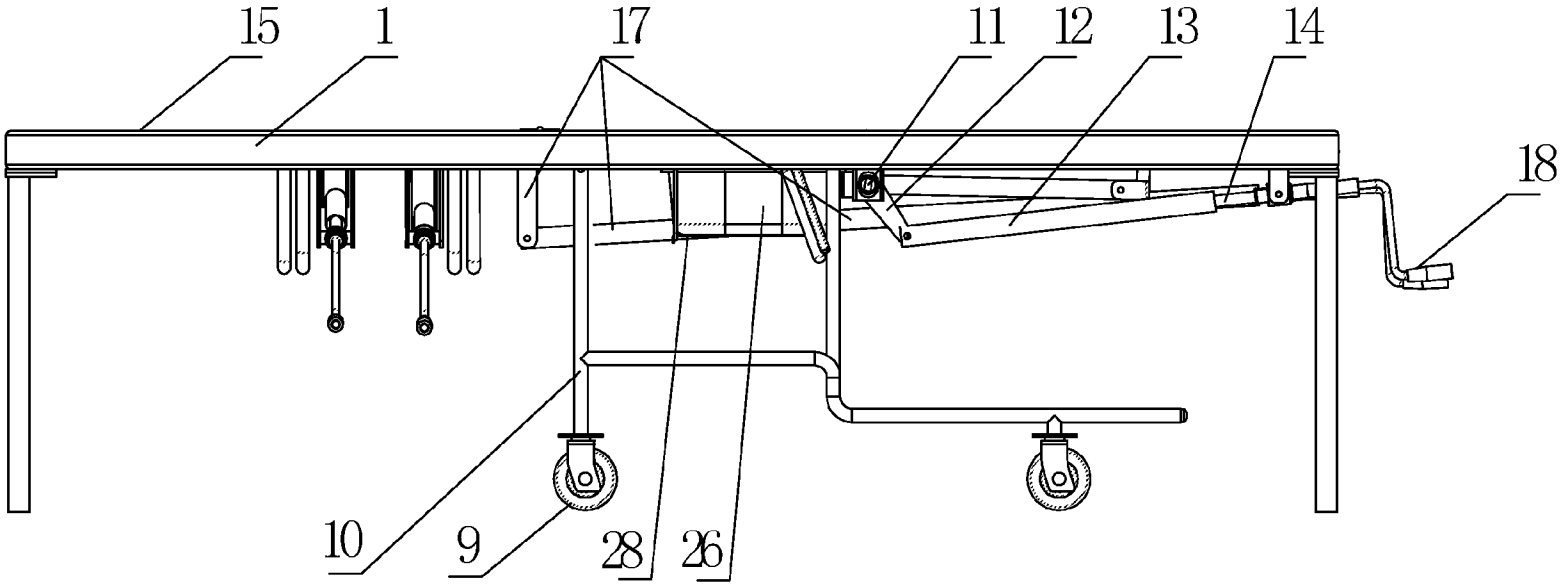
FIG. 2 is a front view of a combined type nursing bed which has a manual push rod and is in a combined status.
Figure 3:
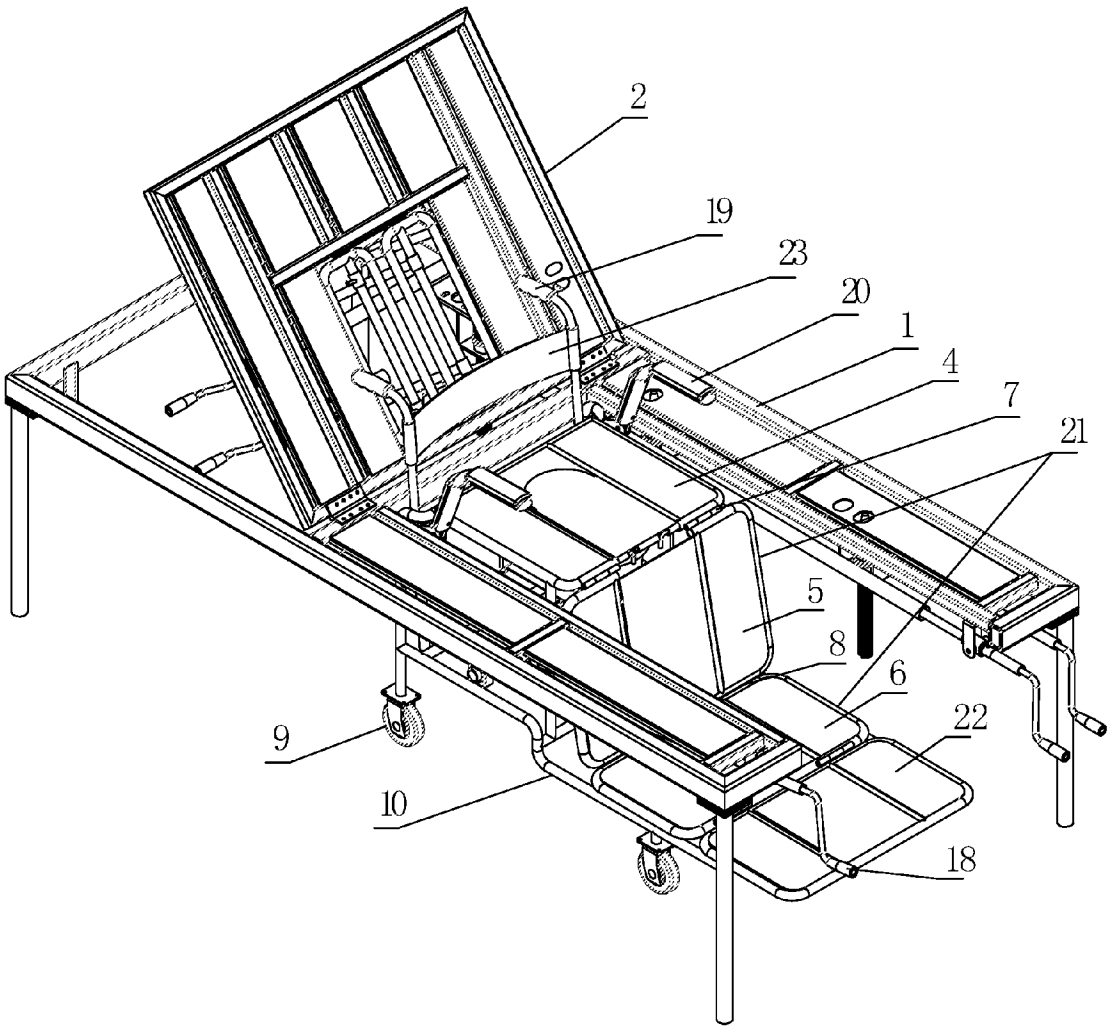
FIG. 3 is a space diagram of a combined type nursing bed which has a manual push rod and is in a separated status.
Figure 4:
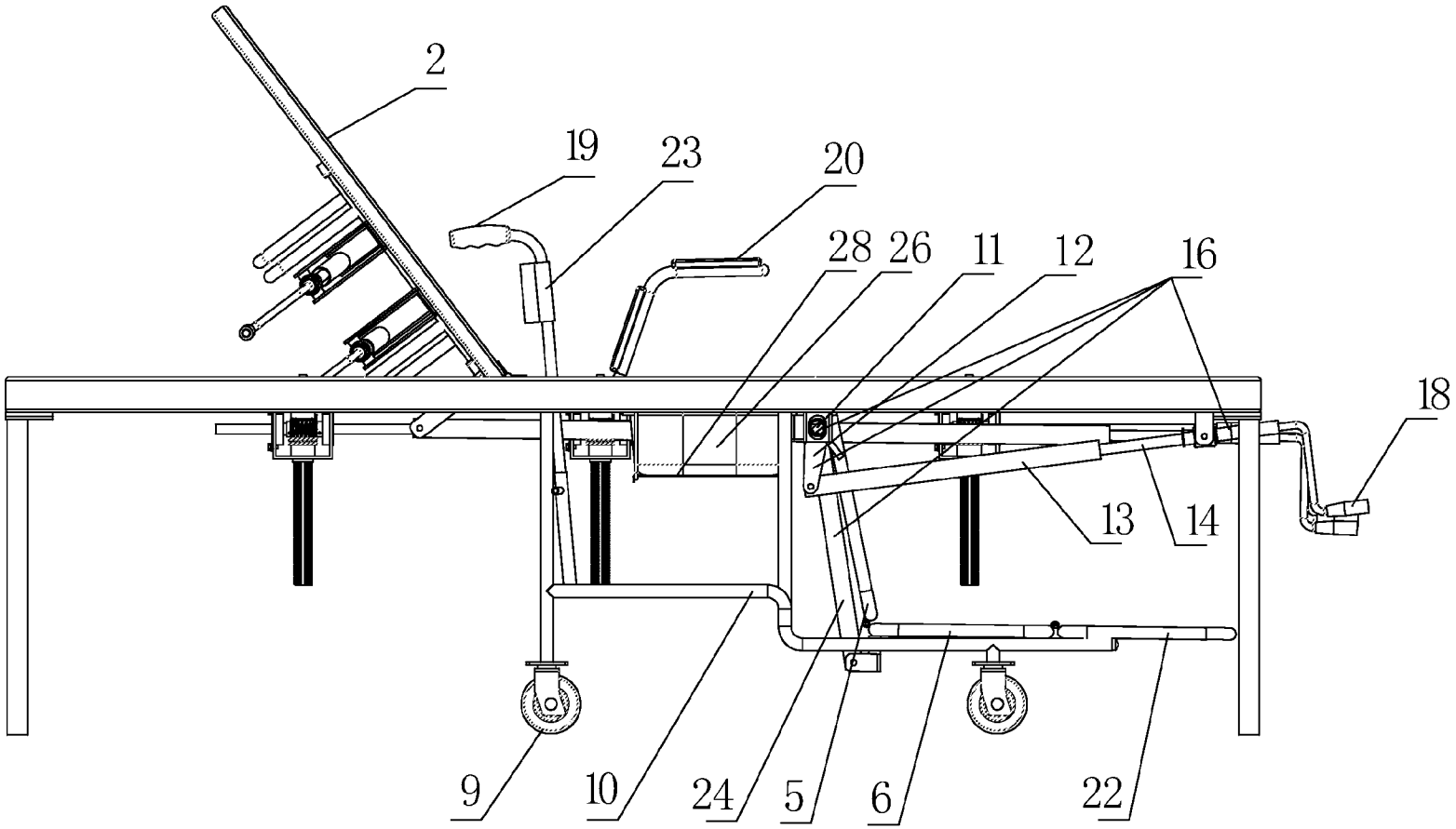
FIG. 4 is a front view of a combined type nursing bed which has a manual push rod and is in a separated status.
Figure 5:
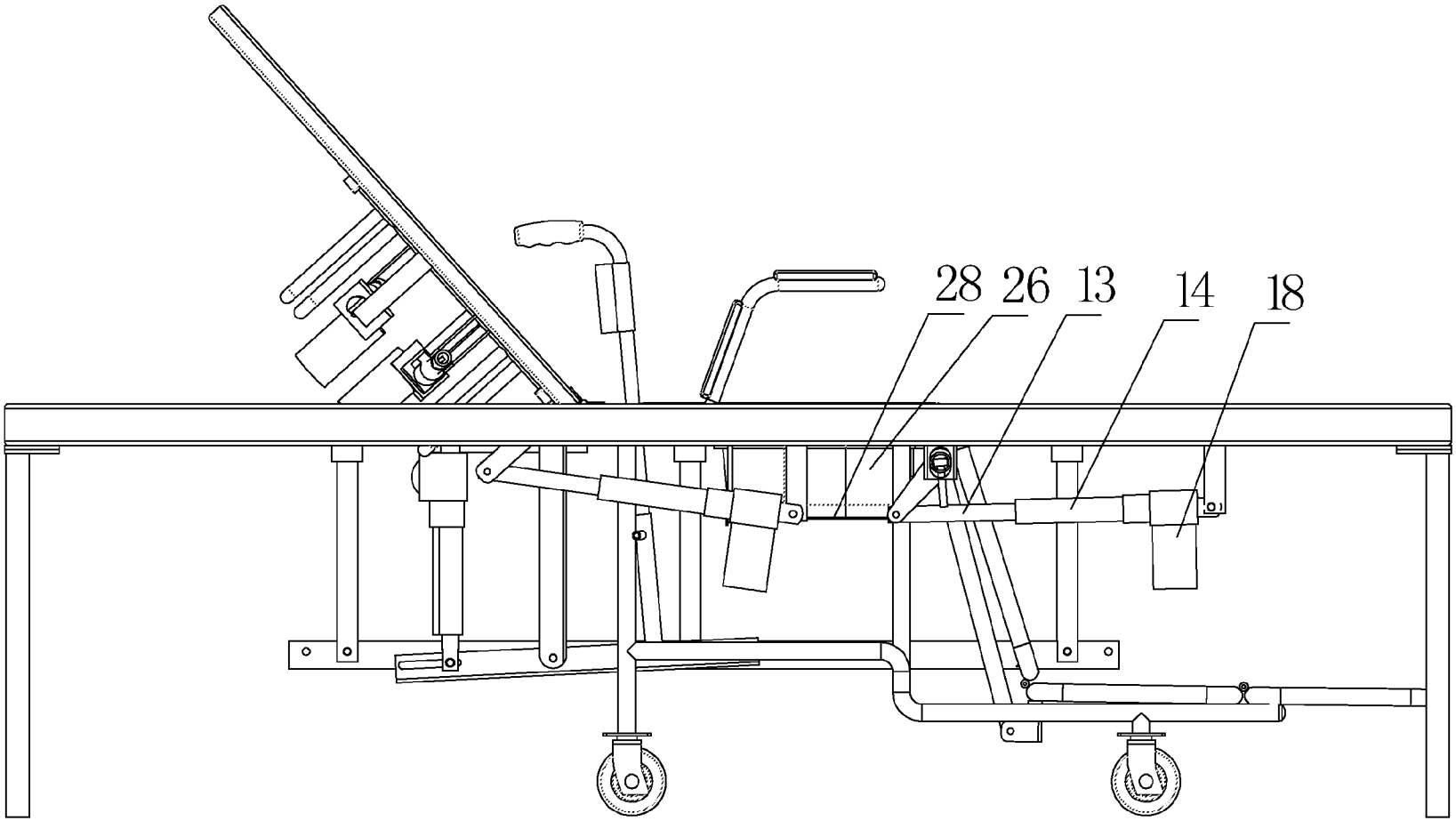
FIG. 5 is a space diagram of a combined type nursing bed which has an electromotion pole and is in a separated status.
Figure 6:
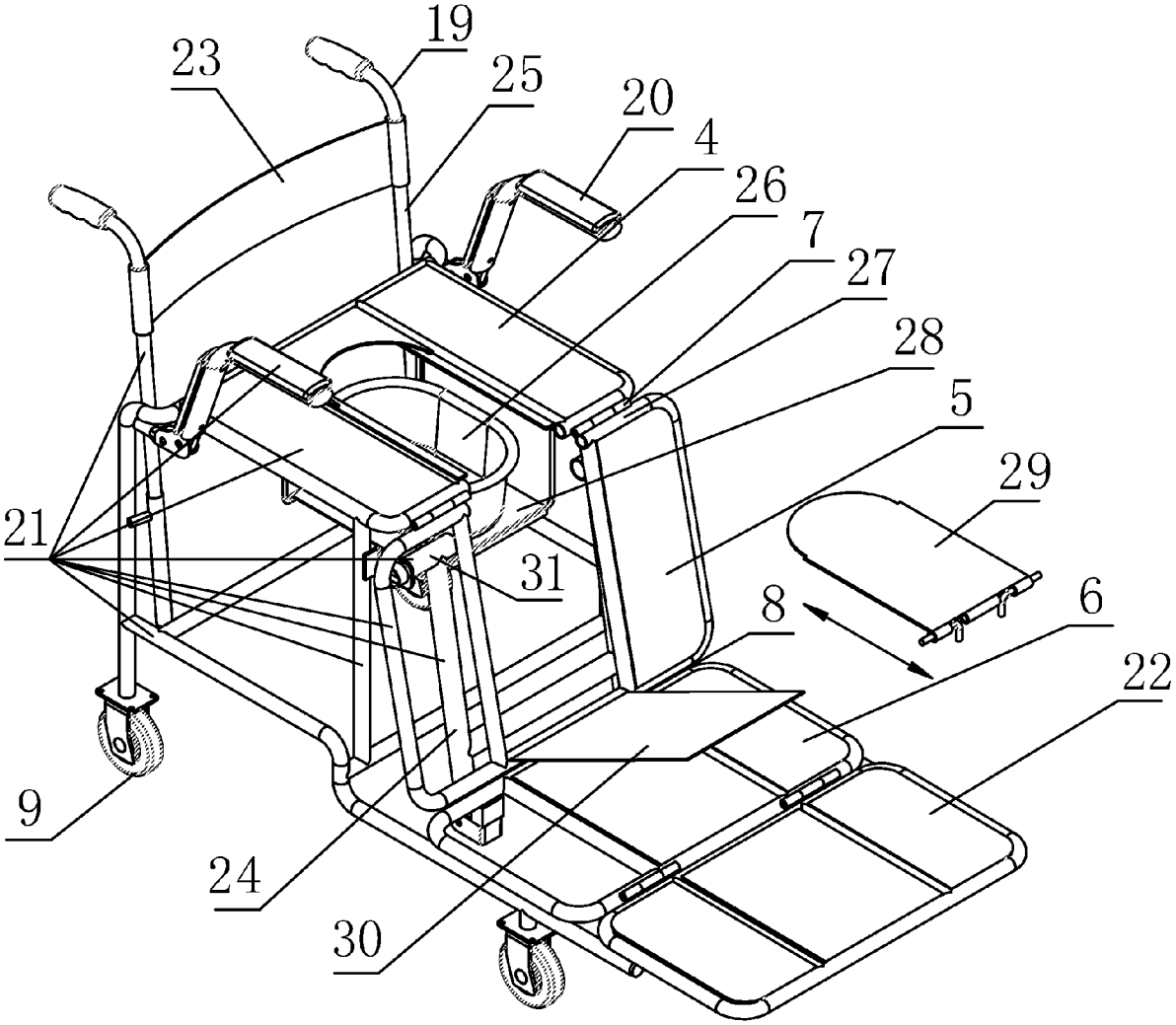
FIG. 6 is a space diagram of a wheelchair separated from the combined type nursing bed.
Figure 7:
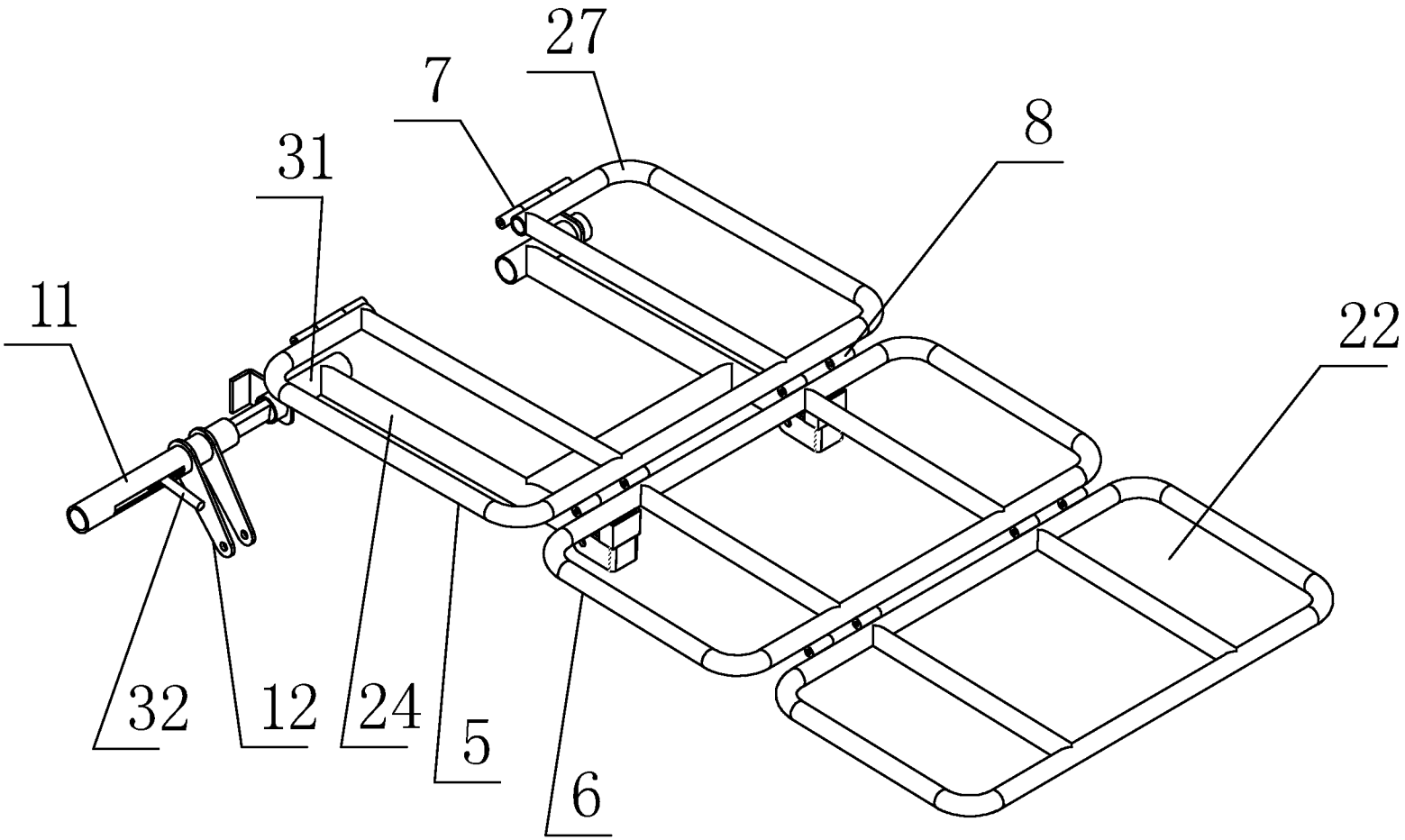
FIG. 7 is a schematic diagram of a driving mechanism of the wheelchair.
Figure 8:
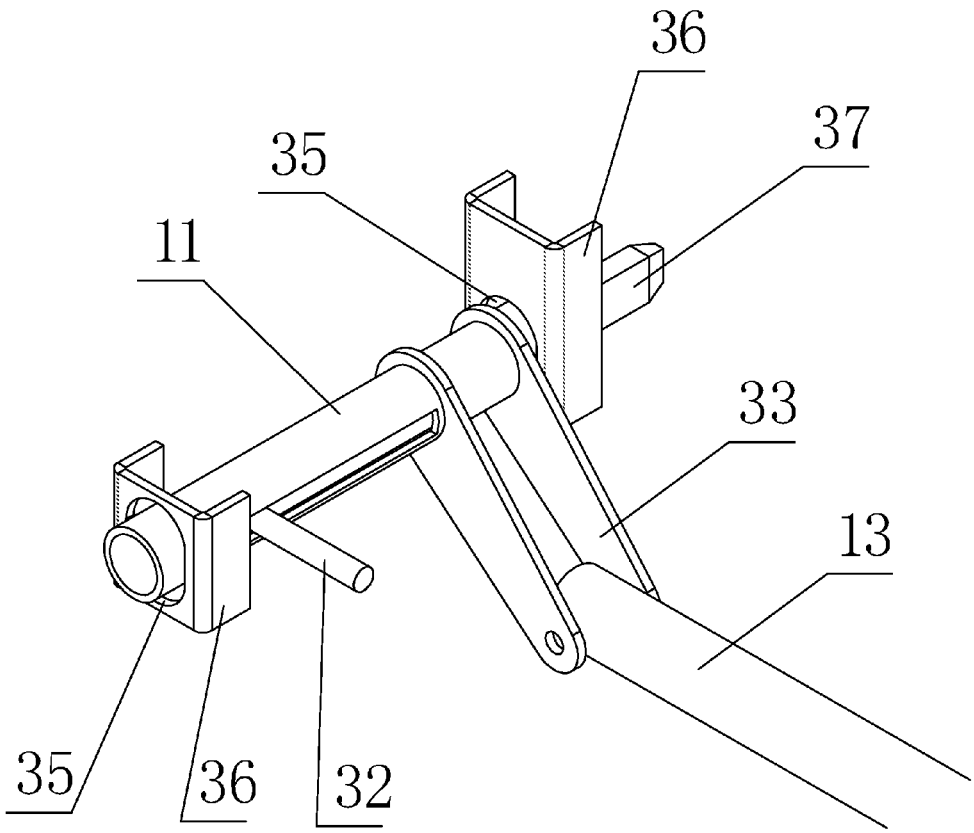
FIG. 8 is a space diagram of a driving rotating shaft.
Figure 9:
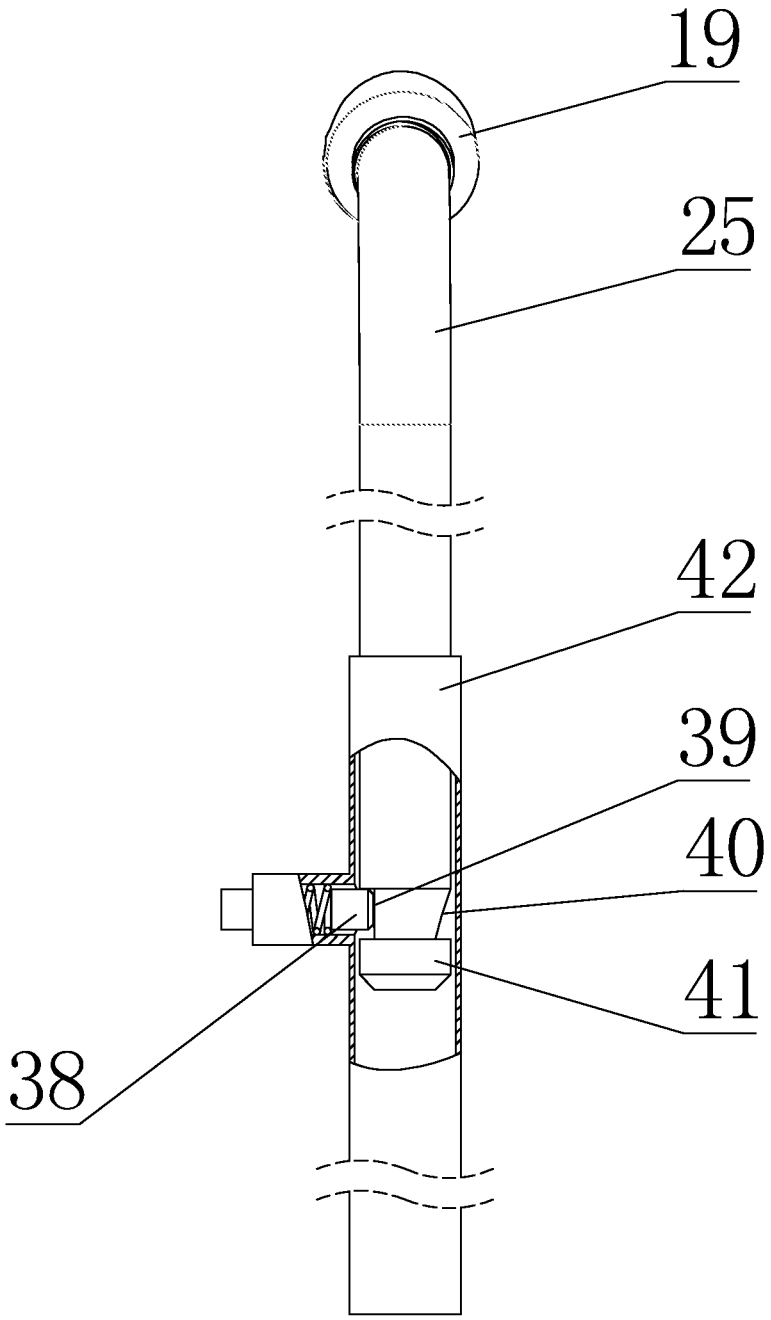
FIG. 9 is a space diagram of a slippage preventing mechanism of the wheelchair backrest.
Figure 10:
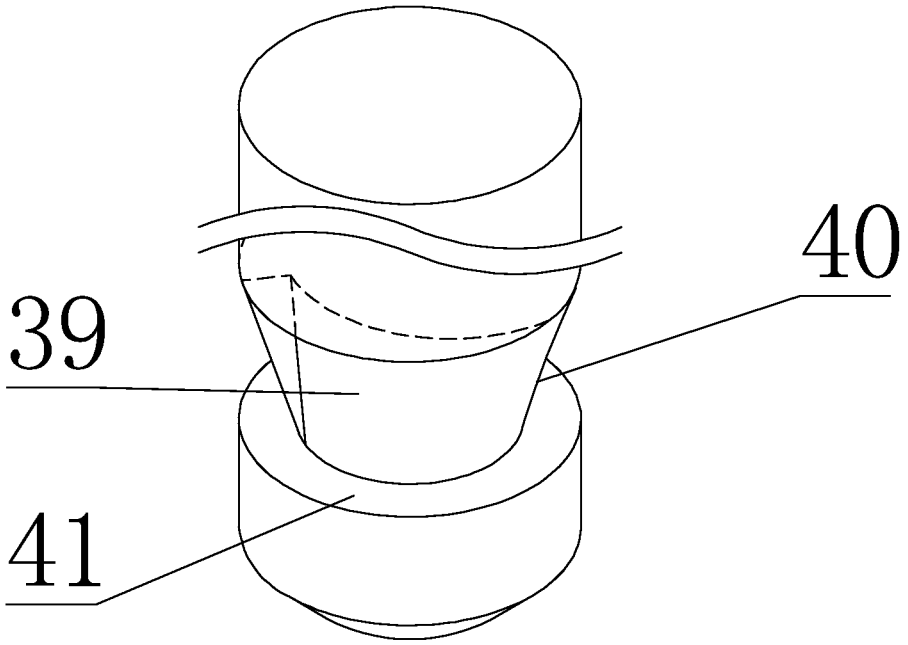
FIG. 10 is a schematic diagram of a pull rod of the wheelchair backrest.

For further illustrating the invention, embodiments detailing a body lifting device used on bed are described below. It should be noted that the following examples are intended to describe and not to limit the invention.

EXAMPLE 1

FIGS. 1-10 show a combined type nursing bed comprising a bed body 1, a moveable backrest 2, and a wheelchair 21.

The moveable backrest 2 is disposed on the bed body 1 and is hinged with the bed body 1 through a first rotating shaft 3. The moveable backrest 2 is driven by a first driving mechanism 17 supported by the bed body 1.

The wheelchair 21 is connected to an end of the moveable backrest 2. The wheelchair comprises three rectangular plates which are separated from the bed body 1, a wheelchair support 10, and a second driving mechanism 16. The width of the three rectangular plates is longer than that of a human body (about 500-600 mm) The three rectangular plates are a first plate 4, a second plate 5, and a third plate 6. When a user is lying on the combined type nursing bed, a plate located below the hip of the user is the first plate 4. The first plate 4 is supported by the wheelchair support 10 and is fixed to the upper end of the wheelchair support 10. The first plate 4 and the second plate 5 are hinged through a second rotating shaft 7, the second plate 5 and the third plate 6 are hinged through a third rotating shaft 8. Wheels 9 are disposed under the front and the rear of the wheelchair support 10. The up-and-down movements of the second plate 5 and the third plate 6 are driven by the second driving mechanism 16. Two driving rotating shaft supports 36 are disposed on and supported by the bed body 1. Axle holes 35 are disposed each on one of the driving rotating shaft supports 36. The axle holes 35 are circular or racetrack-shaped, wherein the straight sides of the racetrack-shaped axle holes 35 are in the perpendicular direction. Two ends of a driving rotating shaft 11 are disposed each in one of the driving rotating shaft supports 36. The driving rotating shaft 11 is rotatable inside the axle holes 35 and is slidable in the racetrack-shaped axle holes 35 in the perpendicular direction. A telescopic component 13 inside the second driving mechanism 16 and a first tumbler 12 fixed on the driving rotating shaft 11 are moveably connected. A fixing component 14 connected to the telescopic component 13 is moveably connected to the bed body 1. A driving component 18 is disposed on the fixing component 14. The driving rotating shaft 11 and a driven rotating shaft 31 supported by the wheelchair support 10 are moveably connected, wherein the driving rotating shaft 11 and the driven rotating shaft 31 are able to rotate synchronously and able to be separated from each other. A second tumbler 24 is fixed on the driven rotating shaft 31, and is moveably connected to a lower surface of the third plate 6. Working step 1: the telescopic component 13 is extended from the second driving mechanism 16 to force the first tumbler 12 of the driving rotating shaft 11 rotates clockwise so that the driving rotating shaft 11 rotates; the driven rotating shaft 31 and the second tumbler 24 are driven to rotate and the third plate 6 is pulled down by the second tumbler 24; the second plate 5 is driven by the third rotating shaft 8 to pivot down from horizontal to vertical around the second rotating shaft 7; the third plate 6 pivots up relative to the second plate 5 around the third rotating shaft 8 and is finally placed on the wheelchair support 10; therefore, the driving rotating shaft 11 and the driven rotating shaft 31 are separated, and the wheelchair 21 and the bed body 1 are separated and can be used independently. Working step 2: the driving rotating shaft 11 is connected to the driven rotating shaft 31, the second driving mechanism 16 works, the telescopic component 13 is drawn back and pulls the first tumbler 12 of the driving rotating shaft 11, the driving rotating shaft 11 drives the driven rotating shaft 31 and the second tumbler 24 to rotate, the second tumbler 24 pushes up the third plate 6, the wheelchair 21 changes into a bed surface 15. The working steps are adapted when the driving rotating shaft 11 and the driven rotating shaft 31 are arranged in different height.

The axle holes 35 which are in a shape of racetrack are disposed on the driving rotating shaft support 36, wherein the straight sides of the racetrack-shaped axle holes 35 are in the perpendicular direction. The driving rotating shaft 11 is rotatable inside the axle holes 35 and is slidable in the racetrack-shaped axle holes 35 in the perpendicular direction. The driven rotating shaft 31 is supported by the wheelchair support 10 and is slidable in the horizontal direction. The driving rotating shaft 11 and the driven rotating shaft 31 are moveably connected and are able to be separated.

The driving rotating shaft 11 and the driven rotating shaft 31 are moveably connected. A bolt 37 which is fitted with an inner hole of the driven rotating shaft is disposed in the driving rotating shaft 11. The cross section of the bolt 37 is a rectangle. A bolt handle 32 protrudes from an opening of the driving rotating shaft 11. Aligning the driving rotating shaft 11 with the driven rotating shaft 31, pushing the bolt handle 32 so that the driving rotating shaft 11 and the driven rotating shaft 31 are connected and pulling the bolt handle 32 so that the driving rotating shaft 11 and the driven rotating shaft 31 are separated.

A moveable wheelchair backrest 23 is disposed at the rear of the wheelchair support 10. The wheelchair backrest 23 is pluggable and is able to move up and down. A pull rod 25 of the wheelchair backrest 23 is inserted into a tube 42; a pluggable slippage preventing mechanism is disposed at the end of the pull rod 25: a slippage preventing step 41 is disposed at the end of the pull rod 25, a rectangular groove 39 and a inclined surface opposite to the rectangular groove 39 are disposed on the upper end of the slippage preventing step 41. When the pull rod is being pulled up, the slippage preventing step 41 is stuck by a compressible bolt 38 so that the pull rod 25 is not drawn out. When a backrest handle 19 is turned into a working position, the compressible bolt 38 is located in the rectangular groove 39, the pull rod 25 is stuck by the compressible bolt 38 and is not able to move up and down; when the backrest handle 19 is turned into a suppressible position, the compressible bolt 38 is abutted against the declined surface 40, the pull rod 25 is able to be inserted into the tube 42 and to be hidden below the bed surface 15.

Two moveable handles 20 are disposed each at one of the two opposite ends of the first plate 4.

A urinal 26 and a holding plate 28 used to hold the urinal 26 is disposed under the first plate of the wheelchair 21. A covering plate 29 is disposed on the first plate 4 and a door plate 30 is disposed on the second plate 5. Openings are disposed on the frame 27 close to the covering plate 29.

The telescopic component 13 and the fixing component 14 of the second driving mechanism 16 are connected to form a mechanism which is able to perform a straight reciprocating motion, such as an electromotion rod and a manual push rod.

The manual push rod comprises a screw bolt and an inner screw thread. The front part of the manual push rod is the telescopic component 13, the rear part of the manual push rod is the fixing component 14 which is moveably connected to the bed body 1, and a driving component 18 at the end of the fixing component 14 is a crank. The electric push rod comprises a screw bolt and an inner screw thread. The front part of the electric push rod is the telescopic component 13, the rear part of the electric push rod is the fixing component 14 which is moveably connected to the bed body 1, and a driving component 18 at the end of the fixing component 14 is a motor.

A pivotable plate 22 is disposed on the third plate 6 of the wheelchair 21.

EXAMPLE 2

Figure 11:
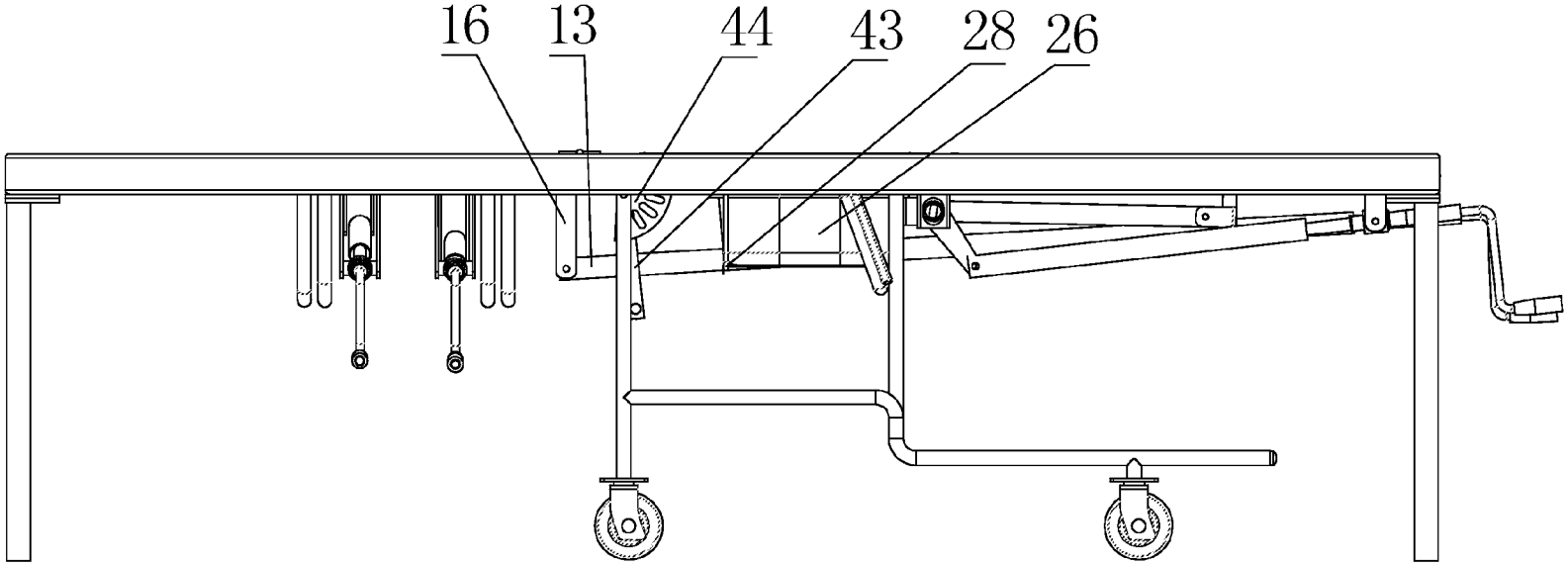
FIG. 11 is a space diagram of a combined type nursing bed which is in a combined status.
Figure 12:
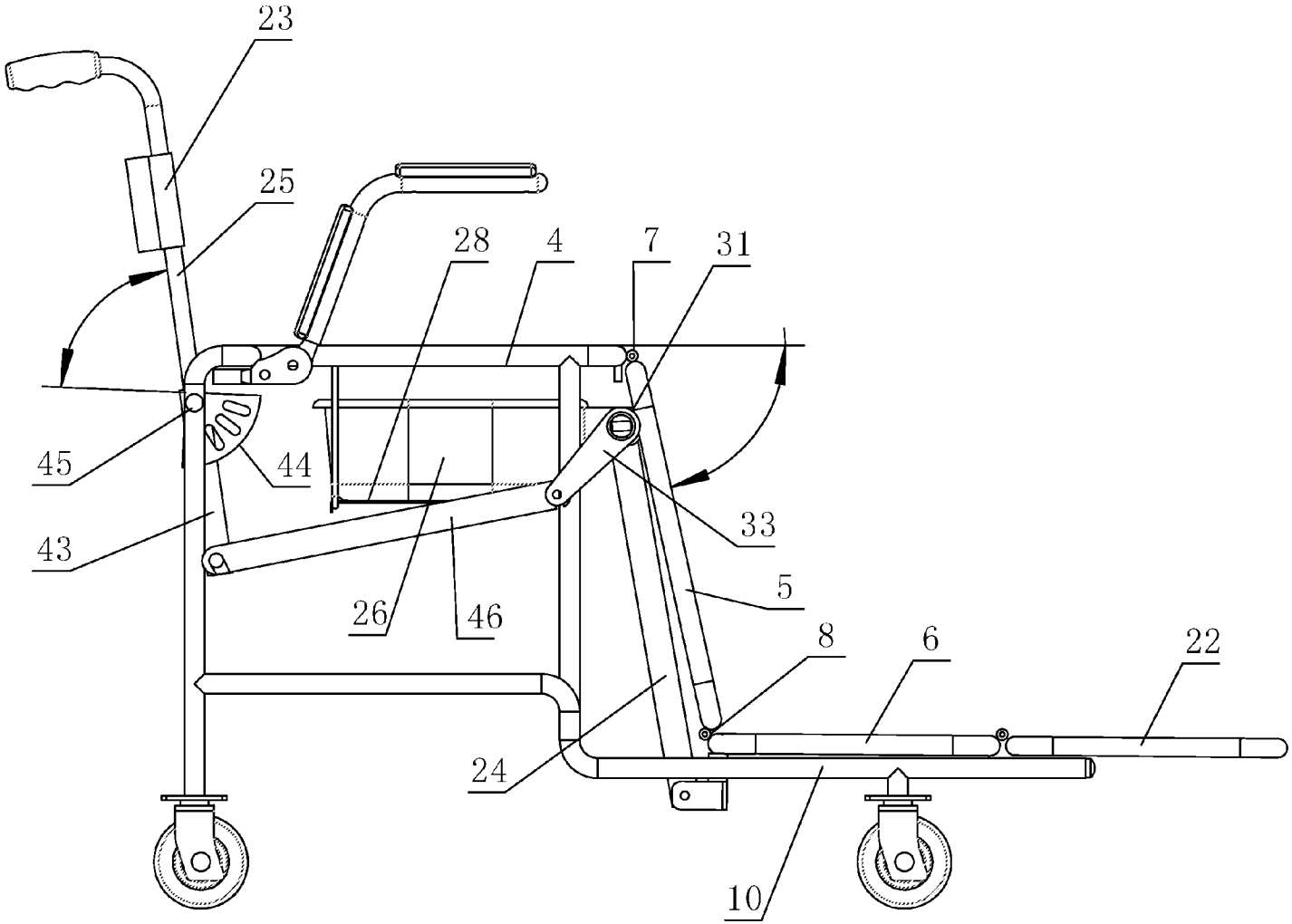
FIG. 12 is a space diagram of a wheelchair which is separated from the combined type nursing bed.
Figure 13:
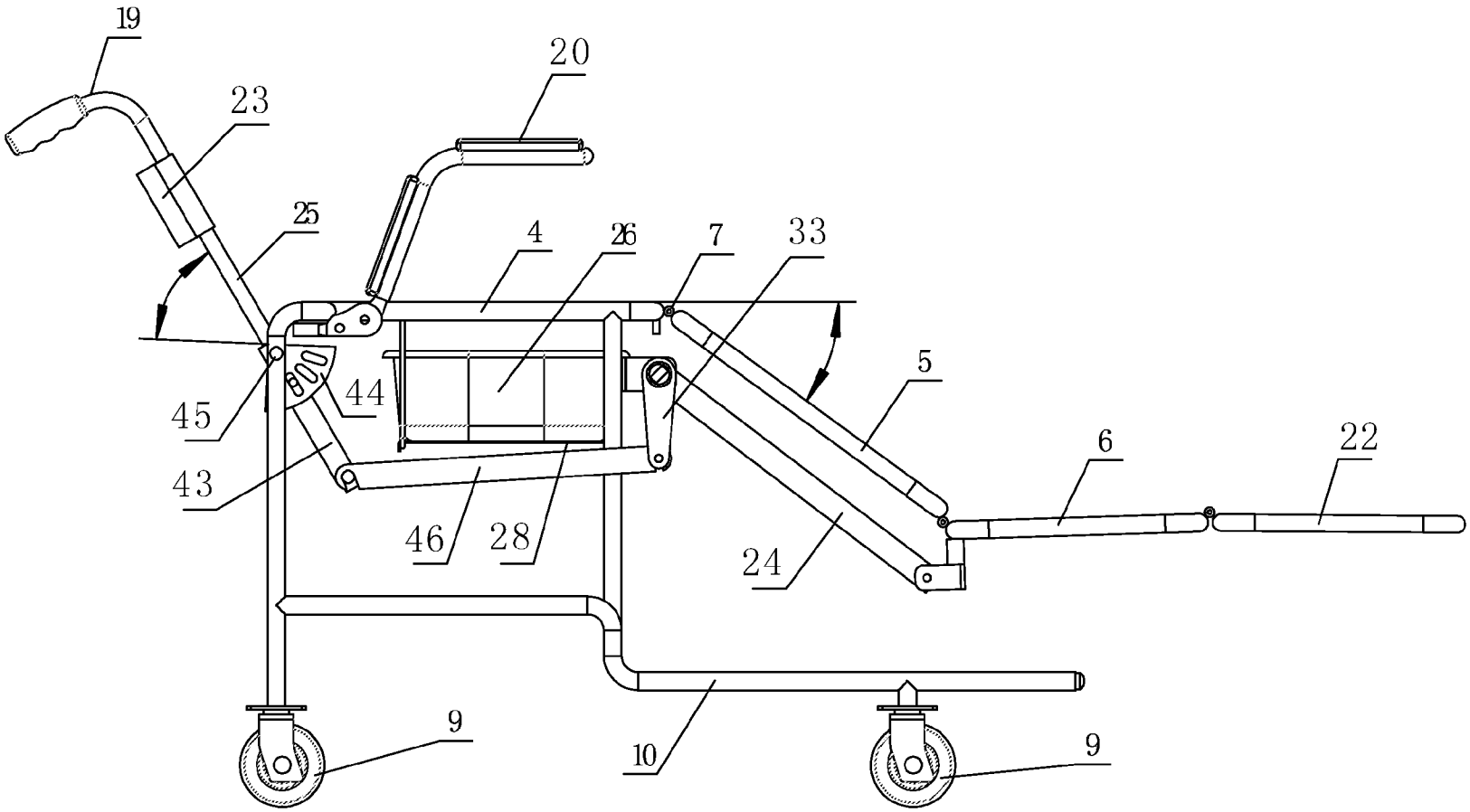
FIG. 13 is a space diagram of a wheelchair which is separated from the combined type nursing bed and is being adjusted.

With reference to FIGS. 11-13, a compass tube 43 is disposed at the rear of the wheelchair support 10 in Example 1. A fourth rotating shaft 45 and a compass component 44 are disposed between the wheelchair 10 and the compass tube 43. A movable rod 46 is disposed between the compass tube 43 and a third tumbler 33 of the driven rotating shaft 31. The moveable rod 46 is able to be separated from the compass tube 43 and the third tumbler 33 of the driven rotating shaft 31. The pull rod 25 of the wheelchair backrest 23 is inserted into the compass tube 43. Turn the wheelchair backrest 23, the driven rotating shaft 31 is driven by the moveable rod 46, and the third plate 6 is lifted by the tumble 24; as a result, the wheelchair 21 changes into a moveable bed.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A combined nursing bed, wherein a moveable backrest is disposed on a bed body and is hinged with the bed body through a first rotating shaft; the moveable backrest is driven by a first driving mechanism supported by the bed body; a wheelchair is connected to an end of the moveable backrest; the wheelchair comprises three rectangular plates which are separated from the bed body, a wheelchair support, and a second driving mechanism; a width of the three rectangular plates is between 500 and 600 mm; the three rectangular plates are a first plate, a second plate, and a third plate; the first plate is supported by the wheelchair support and is fixed to an upper end of the wheelchair support, and the first plate operates as a seat for the wheelchair; the first plate and the second plate are hinged through a second rotating shaft, the second plate and the third plate are hinged through a third rotating shaft; wheels are disposed under the front and the rear of the wheelchair support; the second driving mechanism is mounted on the bed body and comprises a driving rotating shaft, a first tumbler, a telescopic component, and a fixing component, the fixing component is moveably connected to the bed body and drives the movement of the telescopic component, the telescopic component is moveably connected to the first tumbler, and the first tumbler is fixed on the driving rotating shaft; a driving component is disposed on the fixing component; the driving rotating shaft and a driven rotating shaft supported by the wheelchair support are moveably connected, wherein the driving rotating shaft and the driven rotating shaft are able to rotate synchronously and able to be separated from each other; a second tumbler is fixed on the driven rotating shaft, and is moveably connected to a lower surface of the third plate; a moveable wheelchair backrest is disposed at the rear of the wheelchair support; and two moveable handles are disposed each at one of two opposite ends of the first plate.

2. The combined nursing bed of claim 1, wherein two driving rotating shaft supports are disposed on and supported by the bed body; axle holes are disposed each on one of the driving rotating shaft supports; the axle holes are circular; and two ends of the driving rotating shaft are disposed each in one of the driving rotating shaft supports.

3. The combined nursing bed of claim 1, wherein two driving rotating shaft supports are disposed on and supported by the bed body; axle holes are disposed each on one of the driving rotating shaft supports; the axle holes are in a shape of racetrack, and straight sides of the racetrack are perpendicular to a bed surface; and two ends of the driving rotating shaft are disposed each in one of the driving rotating shaft supports.

4. The combined nursing bed of claim 1, wherein a pivotable plate is disposed on the third plate of the wheelchair.

5. The combined nursing bed of claim 1, wherein a urinal and a holding plate used to hold the urinal are disposed under the first plate of the wheelchair; a covering plate is disposed on the first plate and a door plate is disposed on the second plate; and openings are disposed on a frame close to the covering plate.

6. The combined nursing bed of claim 1, wherein a pull rod of the wheelchair backrest is inserted into a tube; a slippage preventing step is disposed at the end of the pull rod; a rectangular groove and a inclined surface opposite to the rectangular groove are disposed on an upper end of the slippage preventing step; and a compressible bolt is disposed on the tube.

7. The combined nursing bed of claim 1, wherein the driving rotating shaft and the driven rotating shaft are moveably connected; a bolt which is fitted with an inner hole of the driven rotating shaft is disposed in the driving rotating shaft;

a cross section of the bolt is non-circular; and a bolt handle protrudes from an opening of the driving rotating shaft.

8. A combined nursing bed, the combined nursing bed comprising:

a bed body comprising a first rotating shaft and a driving rotating shaft having a bolt;

a moveable backrest having an end; and a wheelchair comprising a wheelchair support having an end, a first plate having two opposite ends, a second plate, a third plate, a second rotating shaft, a third rotating shaft, wheels, a driven rotating shaft having an inner hole, a wheelchair backrest, and two moveable handles;

wherein the first plate is supported by the wheelchair support and is fixed to the wheelchair support; the second plate is hinged with the first plate through the second rotating shaft; the third plate is hinged with the second plate through the third rotating shaft; whereby the second plate is pivotable around the second rotating shaft, and the third plate is pivotable around the third rotating shaft;

the bolt of the driving rotating shaft is adapted to be inserted into the inner hole of the driven rotating shaft whereby allowing the driving rotating shaft to be connected with or separated from the driven rotating shaft;

the end of the moveable backrest is hinged with the bed body through the first rotating shaft;

the wheelchair is adapted to be disposed at the end of the moveable backrest;

the wheels are disposed under the wheelchair support;

the wheelchair backrest is moveably connected to the end of the wheelchair support; and the moveable handles are moveably connected each to one of the two opposite ends of the first plate.

* * * * *